United States Patent [19]

Conti

[11] Patent Number: 4,590,878

[45] Date of Patent: May 27, 1986

[54] DECORATIVE STITCH TYPE AND METHOD OF AND APPARATUS FOR PRODUCING SAME

[75] Inventor: Roberto Conti, Milan, Italy

[73] Assignee: Complett S.p.A., Milan, Italy

[21] Appl. No.: 635,819

[22] Filed: Jul. 30, 1984

[30] Foreign Application Priority Data

Jul. 29, 1983 [IT] Italy ..... 22346 A/83
Feb. 9, 1984 [IT] Italy ..... 19525 A/84

[51] Int. Cl.[4] ..... D05B 1/00

[52] U.S. Cl. ..... 112/266.1; 112/154; 112/181; 112/185; 112/400

[58] Field of Search ..... 112/266.1, 262.1, 154, 112/181, 183, 185, 400

[56] References Cited

U.S. PATENT DOCUMENTS 1,314,213 8/1919 Reis ..... 112/266.1
3,207,107 9/1965 Castawy Ferré ..... 112/154 X
4,140,069 2/1979 Laursen ..... 112/154

FOREIGN PATENT DOCUMENTS 243690 5/1960 Australia ..... 112/266.1
959688 6/1964 United Kingdom ..... 112/154

*Primary Examiner*—H. Hampton Hunter
*Attorney, Agent, or Firm*—Karl F. Ross; Herbert Dubno

[57] ABSTRACT

A new stitch type and a method of and an apparatus for making same in which the loop is passed through the fabric through one hole and is returned through another hole and then is passed around a thread supply eye so that the body of the loop engages a single strand of the thread which twists around this loop and is drawn into the second hole. Such pairs of holes are spaced along the seam so that on one side of the fabric the stitches are spaced apart, i.e. the thread is alternately visible and invisible whereas on the opposite side the thread is continuously visible.

15 Claims, 15 Drawing Figures

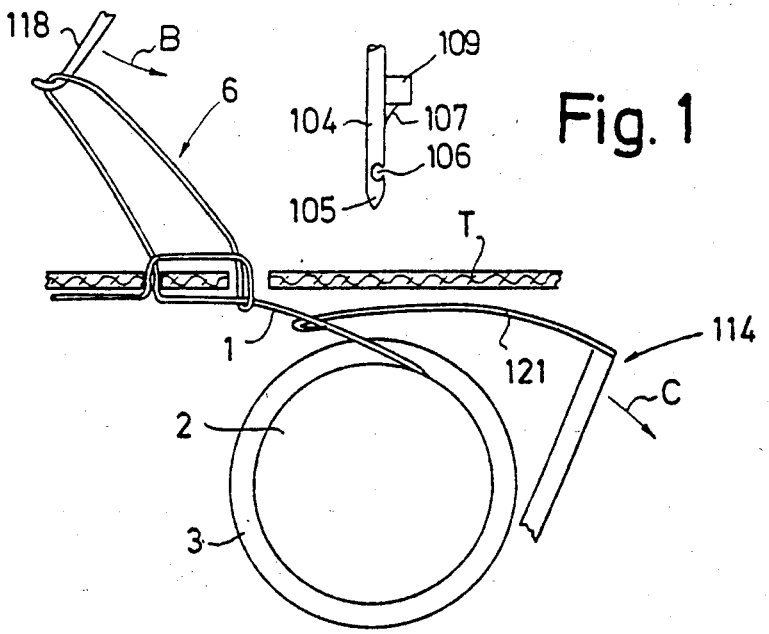
Fig. 1
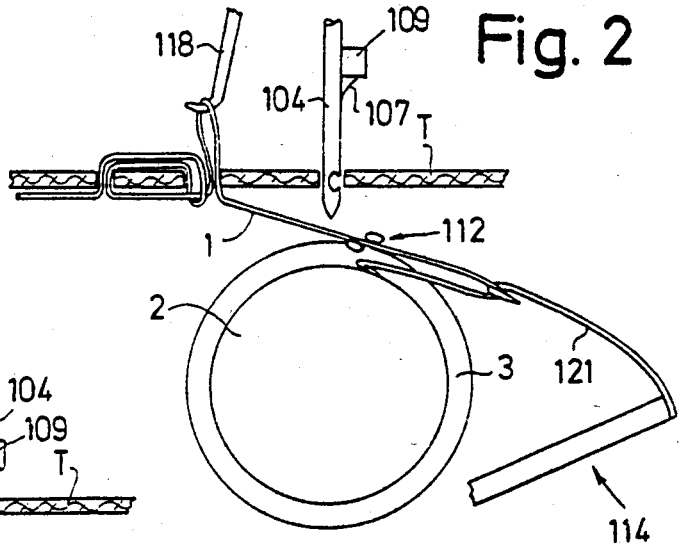
Fig. 2
Fig. 3
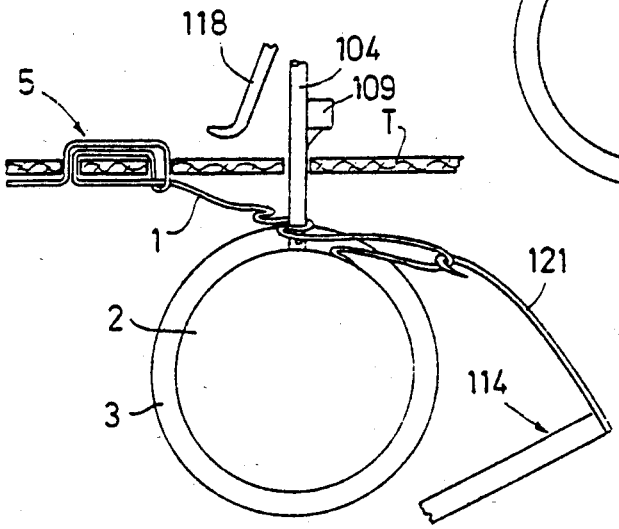

Fig. 6
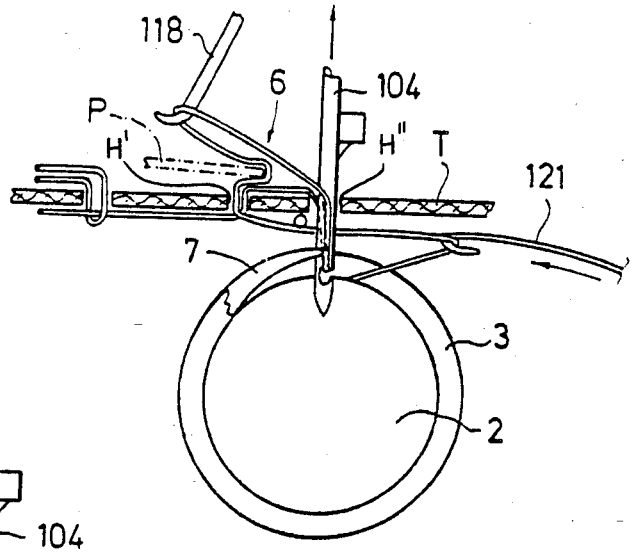
Fig. 7
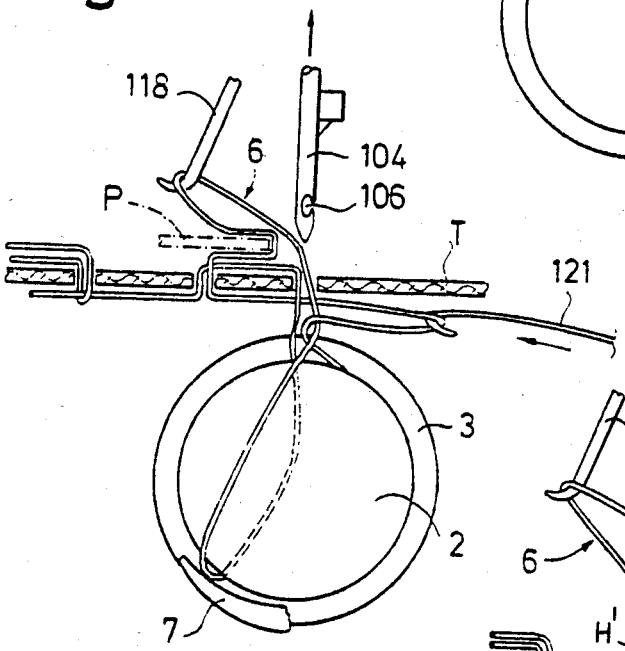
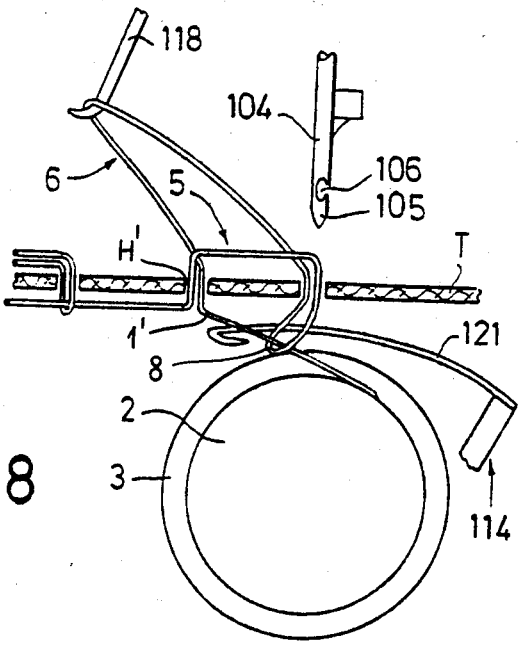
Fig. 8

DECORATIVE STITCH TYPE AND METHOD OF AND APPARATUS FOR PRODUCING SAME

FIELD OF THE INVENTION

My present invention relates to a structurally effective decorative or ornamental stitch type, to a method of producing the new stitch type and to an apparatus or sewing machine mechanism for carrying out the method, i.e. for producing the new stitch type.

BACKGROUND OF THE INVENTION

It is known to produce stitches which are generally described as interlooped stitches, from a single thread by forming a loop and drawing this loop around adjacent portions to other stitches, in effect to form a chain or chain-like structure.

The variety of such stitches is manifold and the present invention is particularly concerned with one class of such stitches in which the thread is alternately visible and invisible on one side of the fabric and appears to be visible continuously along the seam on the opposite side of the fabric, i.e. the one side of the fabric shows the thread in spaced apart stitches which do not appear to be interconnected at this side of the fabric. It is such a stitch type having thread loops reaching over to this side of the fabric and wherein the thread is alternately visible and invisible i.e. wherein the loops appear to be spaced apart without any connection, that is the concern of this invention.

Two such stitch types, by way of example, are stitch type 104 (chain stitch) of the Federal Standard No. 751a and stitch type 209 (saddler and row stitch). Similar stitches are recognized in the German Industrial Standard DIN 61 400.

In the formation of such stitches, on one side of the fabric there appears to be a free space between the successive stitches, a construction which has ornamental advantages and which gives the appearance of hand stitching. Such stitch types are widely used in the garment industry, especially when particularly esthetic or ornamental results are desired with a stitch seam which nevertheless is effective for the fixing of parts of the garment together or for other structural purposes.

The chain stitch 104 is sewn with the aid of two mutually parallel juxtaposed needles, a factor which makes the passage of the seam around corners or with angular portions difficult to achieve neatly.

Furthermore, the spacing between the holes in the fabric spanned by each visible stitch is fixed by the distance between the needles and thus either cannot be altered or can be altered only with considerable difficulty. In addition, the individual stitches formed by the loop which passes through one hole or piercing and a successive hole or piercing, is not locked within one of these holes or otherwise firmly anchored, but rather each loop is merely chained to the next loop on the underside of the fabric so that upon breakage or release of an end of the seam, raveling or loosening of the entire stitch seam may occur. In many ways, therefore, this stitch seam cannot be utilized for structural purposes, i.e. for holding two parts tightly together, but must be treated as a purely decorative stitch seam.

Stitch type 209 has other disadvantages. Firstly, it must be formed with a yarn of limited length, generally 1.5 m, which limits the length of the seam which can be sewn. When the thread is expended, the sewing machine must be stopped and a new thread introduced in a highly time-consuming and inconvenient operation.

In German Pat. DE No. 26 38 264, there is described an apparatus for forming stitch seams with the stitch type 209, but in the formation of such stitches there is always the danger that the fabric will be crimped or bunch up when tension is applied to the thread. This again is because the individual stitches are not truly locked together or secured.

There are, of course, other stitch types in which the stitches are firmly locked against these disadvantageous phenomena, but such stitches do not have the esthetic appearance of stitch types 104 and 209.

OBJECTS OF THE INVENTION

It is, therefore, the principal object of the present invention to provide an improved stitch type wherein the stitches at one side of the fabric are spaced apart, utilizing a looped single thread, whereby the disadvantages of earlier stitch types with a similar appearance are obviated and, in particular, the stitches can be used for securing purposes as well as decorative elements, and the stitch seam can be formed without interruption of the sewing operation even for comparatively long seams.

Another object of this invention is to provide an improved method of making the new stitch type referred to above whereby the danger of bunching of the fabric with the application of tension to the thread is excluded and the continuous sewing length is not limited by the factors mentioned above.

It is also an object of this invention to provide an improved apparatus for producing the new stitch type and carrying out the aforementioned method.

SUMMARY OF THE INVENTION

These objects and others which will become apparent hereinafter are attained, in accordance with the present invention with a stitch type in which between pairs of holes formed in the fabric, a single strand of the continuous thread extends on one side of the fabric while from this side of the fabric at one hole of each pair a loop of the thread passes through the fabric over the other side thereof and back through the other hole of the pair, being looped around the single strand as it runs from a previous stitch to the first-mentioned hole of this pair and such that a bight or sinuous formation or twist is formed in the single thread at the second hole of this pair.

Surprisingly the formation of this bight in the single thread serves to lock the stitches or retain them against raveling even if an end of the thread is raveled or the thread is cut or broken at some location along the seam, and while the fact that the loop passes around the single strand of the thread ensures, at least in part, a freedom from bunching or crimping even with the application of high levels of tension to the thread. It is important that the twisting of the loop and the single strand be effected at the second hole of each pair and it is even more advantageous when the twist is drawn into the second hole by the tension of the thread during sewing of the seam so as to lie close to but inwardly up the underside of the fabric.

According to the invention, therefore, the thread forming the stitch type is passed in a single strand through the apex or bight of the returning thread loop so that it forms a shallow bight or twist, i.e. so that it is twisted with this loop.

According to a method aspect of the invention, a thread portion protruding from a thread supply located at the side of the fabric which is to have the continuous stitch appearance, is clamped firmly and between the retained part and the thread supply, a loop of the thread is formed. This loop is drawn by an open-eye needle through the fabric to the other side thereof through the first of the holes of each pair of holes formed by the passage of the needle through the fabric, the thread loop is then returned to the first-mentioned side of the fabric by the needle on a new pass through the fabric to form the second hole of the pair and the loop now on the first-mentioned side is drawn around the thread supply to pass it over the single strand of the thread and the thread is tensioned or the loops are drawn tight so that sinuous bight or bend is formed in the single strand to define the aforementioned twist.

An apparatus for the purposes described preferably includes the aforementioned needle which can be mounted on a needle bar at the opposite side of the fabric, a thread-loop catcher operated synchronously with the needle for drawing out the requisite length of thread from the supply, means, i.e. appropriate tools for inserting the thread into the eye and control means for controlling the thread during the formation of the loop and the movement of the loop in the manner described. A rotary or oscillating thread-loop catcher can be provided beneath the fabric to guide the thread loop around the entire thread supply, spool or bobbin and when the thread supply is a coil or bobbin, this thread-loop catcher may be a rotary member adapted to orbit the coil and preferably is rotatable about the axis thereof.

When the thread supply is provided on a shuttle, the thread-loop catcher is so oriented that it can open the thread loop so that the shuttle can pass a single strand of the thread through this loop.

Various control means for the loop can include fingers, hooks or the like for retaining and pulling the loop and can be pivotal and synchronized with the operation of the needle.

An eye-closing member can be mounted with lost motion on the needle so that it is intercepted by the fabric as the needle passes through the latter to open the eye. This prevents accidental engagement of the fabric in the eye.

BRIEF DESCRIPTION OF THE DRAWING

The above and other objects, features and advantages of the present invention will become more readily apparent from the following description, reference being made to the accompanying drawing in which:

FIGS. 1–9 are side elevational views in highly diagrammatic form and partially in section or schematized, illustrating successive steps in the production of a stitch seam with a new stitch type in accordance with the invention;

SPECIFIC DESCRIPTION

FIGS. 1–9 show the formation of the new stitch type and will be used to elucidate not only the method of fabrication, but also the details of the structure of the new stitch type.

Figure 14:
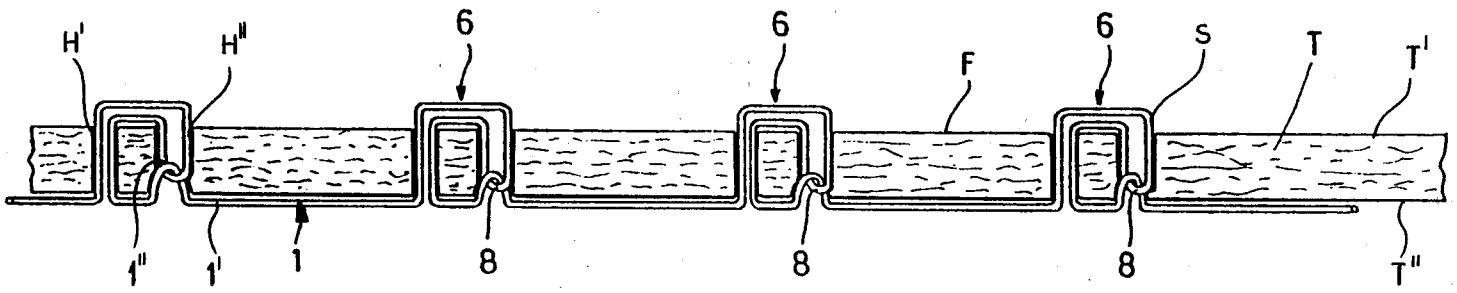
FIG. 14 is a cross-sectional view, also in diagrammatic form, through a fabric provided with the new stitch type.

However, reference should be made first to FIG. 14 which illustrates the new stitch type in highly diagrammatic form.

The fabric workpiece has been represented at T and the upper surface T′ can be considered to be the visible surface of a garment while the lower surface T″ can be deemed to be an inner surface thereof. The stitch seam is formed by a single thread 1 which is stitched through the fabric workpiece. The latter can, of course, represent several layers which are stitched through by the seam and thus are mechanically held together by the row of stitches.

In the formation of the row of stitches, a succession of holes will be formed in the workpiece by the sewing machine needle. These holes can be treated as paired. For example, one hole H′ can be paired with a second hole H″. The spacing between the holes of the pairs and the spacing between the pairs of holes can all be varied utilizing conventional stitching techniques because the hole spaces are not dependent upon two fixedly positioned needles.

A loop 6 of the thread 1 extends from the underside T″ through each hole H′, passes over the upper surface T′ and then passes back through the hole H″ of the pair, the bight 8 of this loop then passing around a single strand 1′ of the thread which can have a twist or sinuous bend 1″ around the bight. This twist can be drawn into the bight.

Consequently, on the upper side T′ of the fabric, stitches S alternate with free spaces F at which the thread is not visible. On the opposite side of the fabric, in the region corresponding to the free spaces F, the single strand 1′ bridges the stitches.

Referring now to FIGS. 1–9 in some detail, it will be apparent that the ornamental seam to be sewn in the single layer or multilayer fabric T utilizes a single thread 1 which, in the usual manner, originates from a coil 2. On the exposed surface of the fabric, the ornamental seam is seen to consist of the thread 1 which is alternately visible and invisible on this side and which is continuously visible, i.e. appears to be uninterrupted on the underside.

The coil 2 in the embodiment of FIGS. 1–13, is arranged in a manner known in the art in a rotating thread loop catcher comprising a coil support 3 which is provided with hooks. The thread catcher or loop catcher of this member 3 orbits the axis of the spool 2 and has been shown at 7 in FIGS. 6 and 7 although it has been omitted from the other Figures under discussion here for the sake of clarity.

Figure 15:
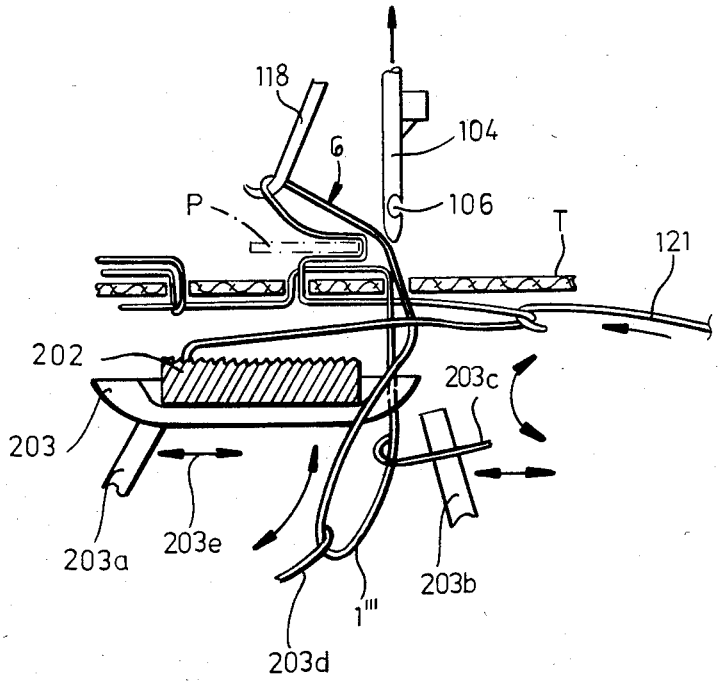
FIG. 15 is a view corresponding essentially to FIG. 7 but showing the use of a shuttle in accordance with the invention.

Alternatively (see FIG. 15) the coil 202 can be provided on a shuttle 203 forming the coil carrier and which is reciprocated as represented by the shuttle actuators **203*a* and 203*b* in the direction of the arrow 203*e* and thereby caused to pass through a loop 1‴ of the single thread 1. The passage of the shuttle through this loop will be seen to be analogous to the passage of the loop of the fixedly located coil 2. Alternatively the coil 2 can be accommodated in an oscillating coil support with hooks. When the shuttle is used, of course, the tip of the shuttle can catch and widen the thread loop and the additional hooks 203***c* and 203*d* need not be used.

In the system of the invention the seam length is not limited commonly for any given garment because the machine can stitch a seam of a length corresponding to the entire thread supply on the coil 2 or 202. Interruption of the operation of the sewing maching during the formation of a seam is therefore not common.

As can be seen from FIG. 1, moreover, the underside 104 with a laterally open eye 106 can be mounted on a needle bar on the head of the sewing machine which overhangs the fabric T and can be part of a sewing machine arm with the usual cam drive, the machine also having the usual dogs for advancing the fabric on a stitch plate which can support the fabric above the spool 2.

The loop 6 of a previous stitch (FIG. 1) is gradually released by a finger 118 on the upper surface of the fabric as a hook 121 engages the tread 1 between the spool and the previous stitch to displace it in the direction of the arrow C and draw out a new loop on the underside of the fabric. The thread portion is thus held in place or retained by the previous stitch. When the formation of the seam is to be commenced, this thread portion is held in place by the fingers of the operator against the fabric or is clamped against the fabric by other means.

Figure 4:
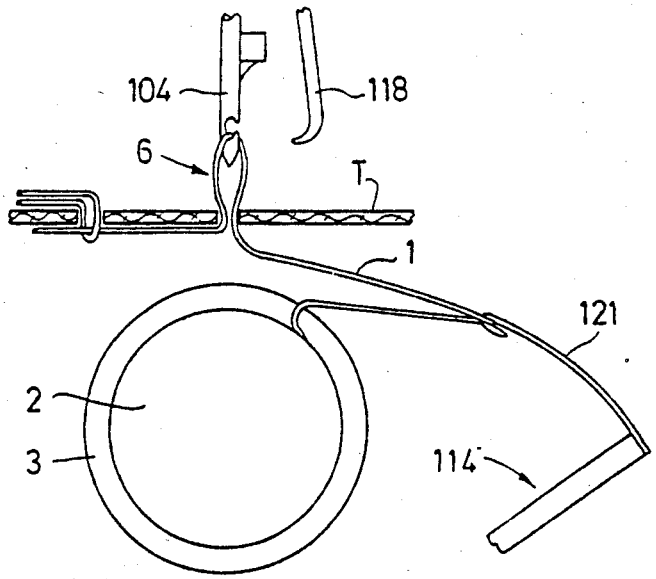

When the needle 104 traverses the fabric (FIG. 2), it swings past a tool 112 for inserting the thread 1 into the open eye of the needle. As the needle 4 is drawn upwardly (compare FIGS. 3 and 4), the thread 1 is pulled up to form a new thread loop on the side of the material T facing away from the coil 2 (FIG. 4).

Figure 5:
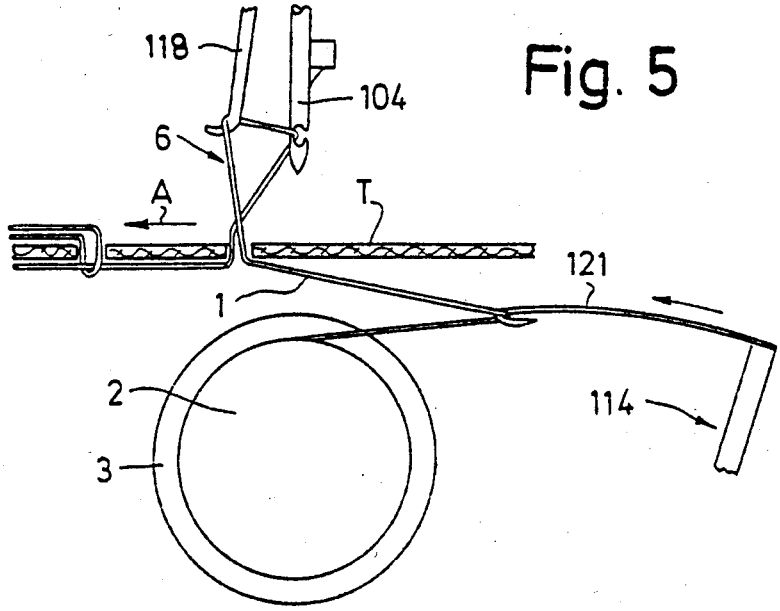
Figure 9:
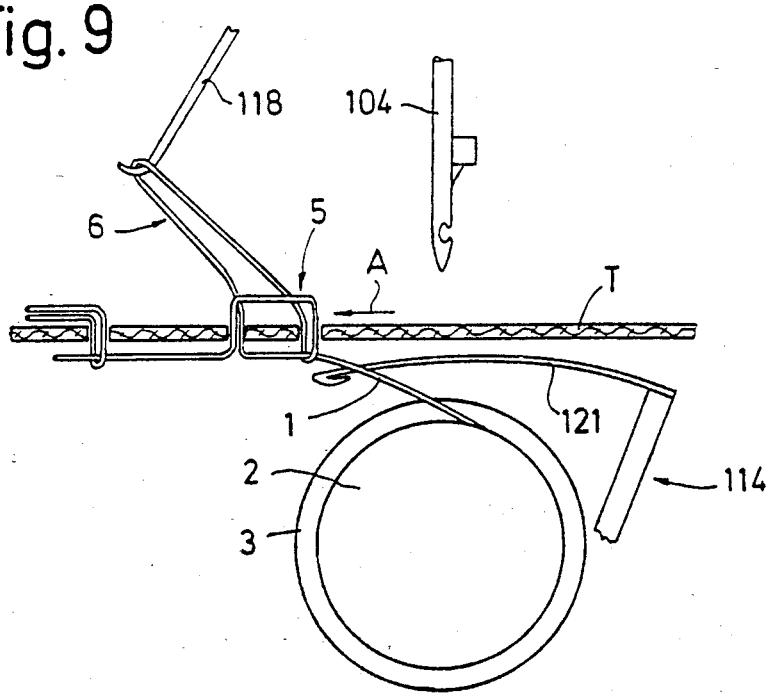

Then the material T is shifted in the direction of arrow A and the loop 6 is engaged by the finger 118 which serves to draw out the loop as the hook 121 returns in the opposite direction. The advance of the fabric in the direction of arrow A can be effected by the feed dogs or some other fabric transport mechanism (FIG. 5).

The needle 104 then pierces the fabric (FIG. 6) to form the second hole H″ of the pair, at a location spaced from the hole H′ by a variable distance. At the same time the rotating gripper 7 or hook of the coil support, which orbits the axis of the coil or bobbin 2 as noted, enters the loop 6 adjacent the needle 104 and spreads this loop while separating it from the eye of the needle.

As the needle retracts, while hook 121 recedes to the left and the finger 118 moves to the right, the gripper 7 sweeps the loop 6 around the entire coil 2 (FIG. 7) and the thread supply of this coil.

Slack in the yarn may be taken up by a member P which can shift parallel to the fabric and closely overlies the latter.

Once the loop 6 has been carried around the thread supply 2, the finger 118 again draws the loop out above the fabric, thereby drawing the bight 8 (FIG. 8) around the strand 1′ between the hole H′ and the thread supply. This completes the formation of the visible stitch portion 5.

Following an additional feeding step in the direction of arrow A of the fabric T, the position shown in FIG. 1 is reached and the stitch-forming process can be repeated.

As can be seen from FIG. 14, not only is the bight in engagement with the single strand 1′ of the thread, but the sinuous 1″ which engages over the bight 8 is twisted thereon so that the pulling up of the single thread or the pulling down of the loops to release the stitches is not possible. While tension on the thread may tighten the threads and compress the fabric, it will not cause serious bunching or crimping. It is, of course, advantageous for the twist to be drawn up slightly into the hole H″ of each pair.

Figure 13:
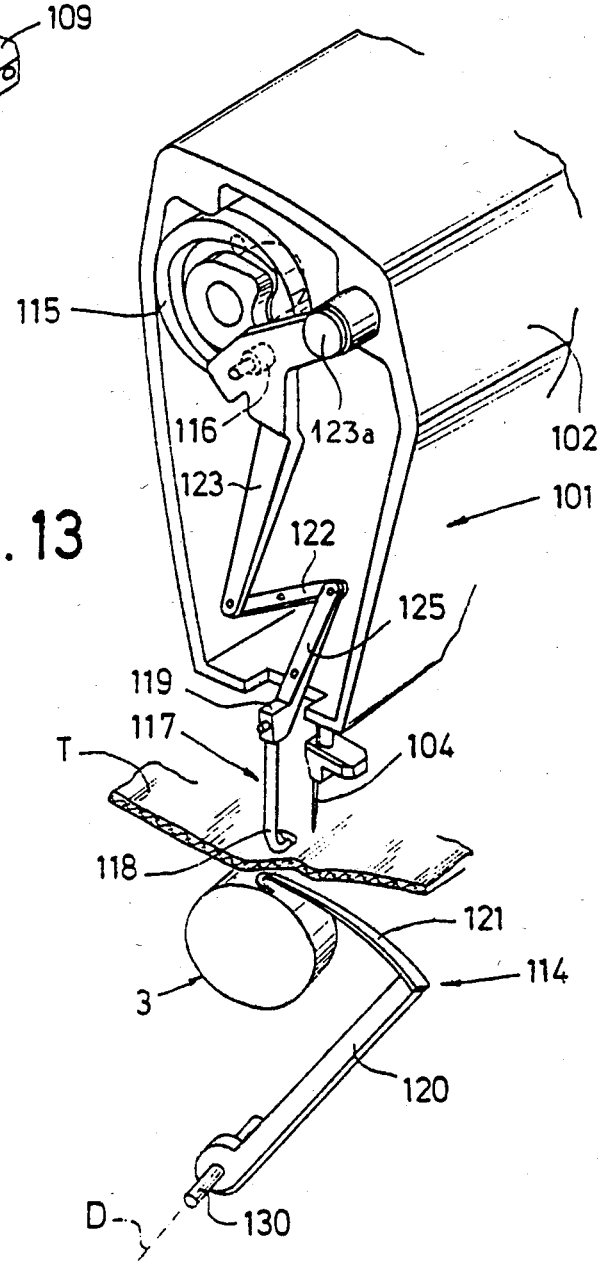
FIG. 13 is a perspective view, partly broken away but in slightly diagrammatic form, illustrating another aspect of the sewing machine of the invention.

As can be seen from FIG. 13, a sewing machine 101 comprises the usual arm 102 of the machine frame and can have a needle bar (not shown) mounted thereon for vertical displacement in the usual manner. The dog and stitch plate are also not shown in this Figure.

Figure 10:
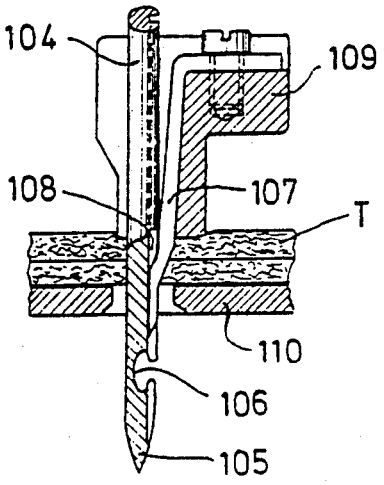
FIG. 10 is a sectional view drawn to a larger scale than any of FIGS. 1–9 illustrating a detail of the needle and a tongue for closing the needle eye.

From FIG. 10 it will be apparent that the needle 104 has a pointed tip 105 and laterally open eye 106, as well as a longitudinal groove 108 which crosses the mouth of the eye. A pressure part 109 of the needle can be mounted with lost motion thereon so that it is entrained upwardly by the needle but is intercepted by the upper surface of the fabric T as the needle pierces the fabric so that a tongue 107 guided in this groove 108 is retracted from the mouth of the eye after the eye is disposed below the stitch plate 110. This prevents the eye 106 from catching in the fabric. From this illustration, moreover, it can be seen that the fabric T can consist of a plurality of layers which are sewn together.

Figure 11:
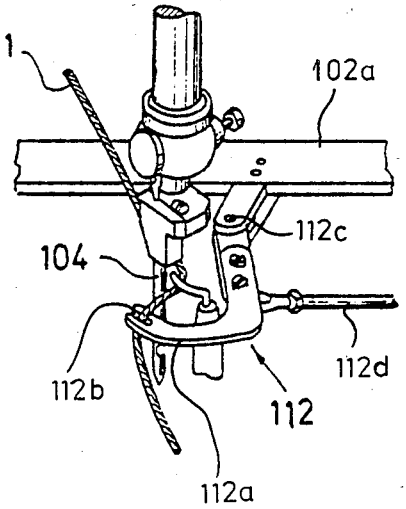
FIG. 11 is a fragmentary perspective view showing the tool for inserting a thread into the needle eye.
Figure 12:
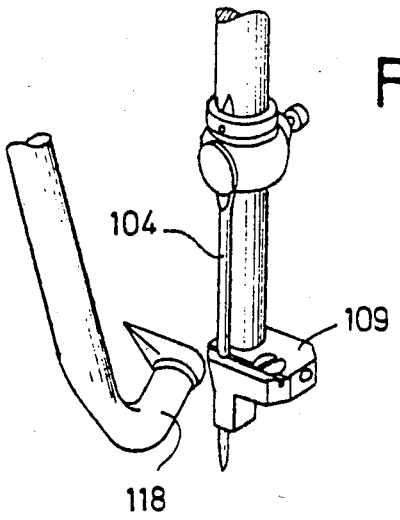
FIG. 12 is a perspective view illustrating the construction of one of the thread control fingers in greater detail.

Referring now to FIGS. 11 and 13, it will be apparent that, in addition to the loop catcher 3, it also serves as the bobbin support and can be driven synchronously with the needle, the tool 112 below the stitch plate and fabric can comprise an arm 112*a* with a slot 112*b* for engaging the thread and carrying it across the needle to fit it into the eye. The arm 112*a* is pivotally mounted at 112*c* on a support 102*a* of the machine and can be angularly displaced synchronously with the needle movement via a rod 112*d*. Thus the operating rhythm of the tool 112 is synchronized not only with the needle 104 but also with the support 3.

Below the fabric and the stitch plate, the hook 121 is carried on a control means represented generally at 114 and comprising an arm 120 which can be pivotally displaced about the shaft D synchronously with the needle and the coil support by means not shown.

The arm 118 is carried by another control means 117 above the fabric and provided for controlling the thread loop during the formation of the stitch. This control means (FIGS. 12 and 13) comprises a clamp 119 or the arm 118 at the end of a lever 125.

The lever 125 can be a double-arm lever fulcrummed on the machine frame 102 and articulated at its arm opposite that provided with the clamp 119 to a lever 123 whose cam follower 116 rides in a cam 115 driven by the arm shaft (not shown) in the usual manner and is thus synchronized with the needle bar and the loop catcher 3. The lever 123 is in turn pivotally mounted at 123*a* upon the machine frame.

The lever 123, the rocker 122 and the lever 125 together form a backgear lever mechanism which increases the pivotal range of the hook 118. The operation of the machine can be appreciated not only from FIGS. 9–13 but also with reference to FIGS. 1–9.

For example, the hook 118 of the upper control means 114 holds the loop 6 of the thread firmly (FIG. 1), and at the beginning of a new stitch forming the process with the fabric C in position, begins to move in the direction of arrow B under the control of the back-gear lever mechanism operated by the cam 115. During this movement, the hook 120 pivots in the direction of arrow C with one phase of the angular oscillation of the shaft 130, thereby picking up the quantity of thread loop 6 released by the finger 118 (FIG. 2).

In the position shown in FIG. 3, the finger 118 has competely released the thread loop 6 which is now engaged by the needle 104 and the thread loop is drawn by the inserter 112 into the open eye. Shortly before the needle has reached its lower dead-center position, the pressure part 109 has come to rest upon the fabric and is held back so that the continued movement of the needle effectively retracts the tongue 107 sufficiently to clear the eye and allow the insertion of the thread.

The balance of the operation of the machine has already been described in connection with the formation of the stitches. It need only be mentioned that the coil 2 of the thread supply can be braked in the holder 3 so that only the amount of thread required is in each case withdrawn from the coil and the thread never significantly slackens.

It should also be apparent that the system can work with a needle whose needle bar is reciprocated from the side on which the thread supply is located or with a double-pointed needle cooperating with two holding means which pass the needle between them from one side of the fabric to the other. The control means 114 is used to tighten the stitches as they are formed and thus to draw the twist somewhat into the hole H".

I claim:

1. A stitch type which comprises a single thread having respective loops each passing from one side of a fabric through a first hole of pairs of holes spaced along said fabric onto the opposite side thereof and returning at least partially through a second hole of each pair so that a bight of each loop engages around a single strand of the thread running from the second hole of one pair of the first hole of another pair of holes along said fabric whereby the stitch thread is visible between the holes of each pair on said other side of said fabric and the thread is invisible between said pairs of holes on said other side of said fabric.

2. The stitch type defined in claim 1 wherein said single strand is twisted with each loop in the region of the second hole of each pair

3. The stitch type defined in claim 2 wherein the twist of each strand with each loop is disposed within the second hole of the respective pair.

4. A method of producing a stitch type as defined in claim 1 which comprises the steps of:

retaining a thread portion spaced from a thread supply disposed at one side of a workpiece to be stitched;

forming a loop between said portion and the thread supply;

piercing said workpiece and entraining said loop through a hole thus formed in the workpiece to the opposite side thereof;

drawing out said loop at said opposite side of said workpiece;

thereafter piercing said workpiece at a location spaced from said hole to thereby form a second hole in said workpiece and entraining said loop from said other side to said one side of said workpiece;

passing said loop on said one side of said workpiece around said thread supply to thereby engage said loop around a single strand of said thread and twist said single strand with said loop and thereby form a stitch; and repeating the aforesaid steps to form a stitch seam with said thread visible only at spaced apart locations on said other side of said workpiece.

5. The method defined in claim 4, further comprising the step of braking said thread supply as said thread is drawn therefrom.

6. The method defined in claim 4 wherein the entire amount of thread needed for the formation of said stitch is pulled following the passage of the thread loop through said workpiece via the first mentioned hole from said thread supply, and excess thread is taken up during passage of loop around the single strand of thread to form a twist between said single strand and said loop.

7. In a sewing maching for producing a stitch by retaining a thread portion spaced from a thread supply disposed at one side of a workpiece to be stitched;

forming a loop between said portion and the thread supply;

piercing said workpiece and entraining said loop through a hole thus formed in the workpiece to the opposite side thereof;

drawing out said loop at said opposite side of said workpiece;

thereafter piercing said workpiece at a location spaced from said hole to thereby form a second hole in said workpiece and entraining said loop from said other side to said one side of said workpiece;

passing said loop on said one side of said workpiece around said thread supply to thereby engage said loop around a single strand of said thread and twist said single strand with said loop and thereby form a stitch; and repeating the aforesaid steps to form a stitch seam with said thread visible only at spaced apart locations on said other side of said workpiece and wherein an oscillatingly propelled needle pierces said workpiece and has an open eye and cooperates with a thread loop catcher operated synchronously with the needle and a tool for inserting the thread into said eye, the improvement wherein said thread loop catcher guides the thread loop on said one side of said workpiece around the entire thread supply.

8. The sewing machine defined in claim 7 wherein said thread supply is a coil and said thread loop catcher includes a gripper orbiting the axis of said coil.

9. The sewing machine defined in claim 7 wherein said thread supply is provided on a shuttle which carries the thread supply through said loop.

10. The sewing machine defined in claim 7, further comprising a first control means on said one side of said workpiece for tightening said twist and controlling the quantity of thread adapted to form said loop.

11. The sewing machine defined in claim 10 wherein said first control means comprises a pivotal arm and a hook formed at the end of said arm and engageable with said thread.

12. The sewing machine defined in claim 11 wherein said arm is pivotable about an axis substantially perpendicular to the direction of movement of said needle.

13. The sewing machine defined in claim 10, further comprising a second control means cooperating with said first control means and including a hook-shaped finger engageable with said loop on said other side of said workpiece for coacting with said first control means to control the quantity of thread drawn from said supply to form said loop.

14. The sewing machine defined in claim 13 wherein said second control means includes a pivotal arm and a rocker articulated to said arm for increasing the range of swing thereof.

15. The sewing machine defined in claim 14 wherein said thread supply is received in a rotatable support provided with a gripper engaging said loop and orbiting said thread supply.

* * * * *